US010777348B2

(12) United States Patent
Haslehner

(10) Patent No.: US 10,777,348 B2
(45) Date of Patent: Sep. 15, 2020

(54) WINDING LAYER PITCH COMPENSATION FOR AN AIR-CORE REACTOR

(71) Applicant: Trench Austria GmbH, Leonding (AT)

(72) Inventor: Otto Haslehner, Heiligenberg (AT)

(73) Assignee: Siemens Aktiengesellschaft, Munich (DE)

( * ) Notice: Subject to any disclaimer, the term of this patent is extended or adjusted under 35 U.S.C. 154(b) by 291 days.

(21) Appl. No.: 14/771,571

(22) PCT Filed: Jan. 14, 2014

(86) PCT No.: PCT/AT2014/050009
§ 371 (c)(1),
(2) Date: Aug. 31, 2015

(87) PCT Pub. No.: WO2014/138762
PCT Pub. Date: Sep. 18, 2014

(65) Prior Publication Data

US 2016/0005529 A1 Jan. 7, 2016

(30) Foreign Application Priority Data

Mar. 15, 2013 (AT) ..... A 50179/2013

(51) Int. Cl.
*H01F 27/30* (2006.01)
*H01F 27/00* (2006.01)
*H01F 27/28* (2006.01)

(52) U.S. Cl.
CPC ..... *H01F 27/306* (2013.01); *H01F 27/006* (2013.01); *H01F 27/2823* (2013.01)

(58) Field of Classification Search
CPC .. H01F 27/306; H01F 27/006; H01F 27/2823; H01F 30/08
(Continued)

(56) References Cited

U.S. PATENT DOCUMENTS 1,159,770 A * 11/1915 Hyde ..... H01F 27/325 336/198
2,052,649 A * 9/1936 Patterson ..... H05B 6/108 336/207
(Continued)

FOREIGN PATENT DOCUMENTS

CA 1114465 A1 12/1981
CN 1073309 6/1993
(Continued)

OTHER PUBLICATIONS

Office Action dated Jul. 4, 2016 which issued in the corresponding Chinese Patent Application No. 201480016120.9.
(Continued)

*Primary Examiner* — Elvin G Enad
*Assistant Examiner* — Malcolm Barnes
(74) *Attorney, Agent, or Firm* — Cozen O'Connor

(57) ABSTRACT

A winding layer pitch compensation for an air-core reactor which has at least two radially spaced apart concentric winding layers, includes a first set of strip-shaped star sheets, each of which is configured to be arranged radially below or above the winding layers and which are provided with at least one receiving slot along an edge extending from that edge, a second set of strip-shaped compensation sheets, each of which is provided with at least one insert slot along an extending from another edge, where a compensation sheet can be inserted into each receiving slot of a star sheet in a formfitting manner, where the star sheet engages into the insert slot of the compensation sheet in a formfitting manner, and where the slot depths of at least two receiving slots of the set of star sheets are different.

8 Claims, 3 Drawing Sheets

(58) Field of Classification Search
USPC ..... 336/208, 199, 207, 185
See application file for complete search history.

(56) References Cited

U.S. PATENT DOCUMENTS 3,264,590 A * 8/1966 Trench ..... H01F 37/005 336/60
3,696,315 A * 10/1972 Riggins ..... H01F 17/08 336/207
4,270,112 A * 5/1981 Schneider-Muntau ..... H01F 27/306 336/207
5,027,099 A * 6/1991 Burke ..... H01F 37/005 336/180
5,202,584 A * 4/1993 Burke ..... H01F 27/085 307/105
5,225,802 A * 7/1993 Dudley ..... H01F 27/306 336/207
2011/0001600 A1* 1/2011 Zillmann ..... H01F 27/306 336/208
2011/0043320 A1* 2/2011 Reisinger ..... H01F 27/343 336/84 R
2015/0170818 A1* 6/2015 Sharp ..... H01F 37/005 336/60

FOREIGN PATENT DOCUMENTS

CN 102007552 4/2011
EP 0084412 A1 7/1983
EP 0529905 A1 * 3/1993 ..... H01F 27/30
WO WO 2009126977 A1 10/2009

OTHER PUBLICATIONS

Office Action dated Aug. 31, 2018 issued in India Patent Application No. 7571/DELNP/2015.

* cited by examiner

WINDING LAYER PITCH COMPENSATION FOR AN AIR-CORE REACTOR

CROSS-REFERENCE TO RELATED APPLICATIONS

This is a U.S. national stage of application No. PCT/AT2014/050009 filed 14 Jan. 2014. Priority is claimed on Austrian Application No. 50179/2013 filed 15 Mar. 2013, the content of which is incorporated herein by reference in its entirety.

BACKGROUND OF THE INVENTION

1. Field of the Invention

The present invention relates to a winding layer pitch compensation for an air-core reactor which has at least two concentric winding layers spaced apart radially from one another.

2. Description of the Related Art

Air-core reactors are used in energy supply networks and, by contrast with oil-insulated reactors, are "dry-insulated reactors", in which the insulation is provided by solid insulation and sufficient air clearances and creepage distances and which as a rule also do not contain any ferromagnetic core, i.e., their central air space is free.

The concentric winding layers of the air-core reactor are each held at their upper and lower axial ends by a holder star, which is composed of a number of star-shaped arms disposed radially. Instead of a one-piece holder star, a plurality of individual star sheets can also be used in each case, which only lie in the area below and above the winding layers, in order to save on star sheet material. The holder stars or star sheets lying opposite one another are tensioned in relation to one another in such cases with the aid of spacer strips or tension bandages extending between the winding layers, in order to hold the winding layers. During winding of the reactor, the star sheets and spacer strips are simultaneously used as winding aids, in that the lower star sheets are initially tensioned on a turning device and the winding layers are then constructed thereon, where a set of spacer strips is installed between them in each case.

As a result of the different conductor cross sections in the individual winding layers different pitches and/or axial installation heights of the individual winding layers are produced in such cases, which require winding layer pitch compensation. Here, compensation sheets are inserted between the star sheets lying opposite one another axially and the winding layer lying between said sheets, which support the winding layers in relation to the star sheets and center them in an axial direction.

Conventional compensation sheets are relatively complex parts because the height to be compensated for between a star sheet and a winding layer varies depending on the circumferential location of the reactor, radial location of the winding layer and conductor cross-section of the winding layer, which even for a single coil dimensioning demands a plurality of different individually-calculated compensation sheets. For different coil dimensionings, the required variations in compensation sheets multiply.

SUMMARY OF THE INVENTION

In view of the foregoing, it is an object of the invention to overcome the disadvantages of the known solutions and to provide a simplified winding layer pitch compensation for air-core reactors.

These and other objects and advantages are achieved in accordance with the invention achieved by the combination of a first set of strip-shaped star sheets, which are each intended to be radially arranged below or above the winding layers and are provided along one edge with at least one receiving slot emanating from the edge, and a second set of strip-shaped compensation sheets, which are provided in each case along one edge with at least one insert slot emanating from the edge, where a compensation sheet is pushable into each receiving slot of a star sheet in a form fitting manner and the star sheet in this case engages in a form fitting manner into its insert slot, and where the slot depths of at least two receiving slots of the set of star sheets are different.

In accordance with the invention, a modular plug-in system is thus created for constructing winding layer pitch compensation from only a few variable parts, these being on the one hand compensation sheets and on the other hand star sheets, which based on the their slots are able to be slotted into one another to make a form fit, where the slot depths in the star sheets define the protrusion, i.e., effective compensation height of the compensation sheets. Through this the compensation sheets can be all designed uniformly, however, with different thicknesses corresponding to the conductor cross section as explained in greater detail below, and thus produced and stocked very simply in few variants. The slot depths of the star sheets can be simply pre-calculated and then the slots made to the corresponding depths, which represents a comparatively simple final production step and can be undertaken, for example, on uniform types of unslotted star sheet blanks. Overall, a mechanically highly-rigid system extremely variable in its dimensioning and compensation options is produced, which very much facilitates both the production and also the stockkeeping of the winding layer pitch compensation.

For single layer area reactor, cores star sheets can be used that have only a single receiving slot, where the slot depths of the receiving slot can then be different within the set of star sheets between different star sheets. For multilayer air core reactors, it is especially advantageous when each star sheet has at least two receiving slots spaced apart from one another emanating from the edge, of which the slot depths are different, so that different effective compensation heights for different layers can be created for each individual star sheet.

In accordance with a preferred embodiment of the invention, the star sheets are made of metal and the receiving slots are milled into the sheets. On the one hand, this fulfils the requirements for high rigidity of the star sheets which must carry the great weight of the winding layers and, on the other hand, this makes possible an overall rapid and highly precise final production of the star sheet blanks, e.g., by CNC milling to the desired slot depths.

Furthermore, it is especially useful if the compensation sheets including their insert slots are molded or cut from plastic. In this way, the compensation sheets can simultaneously exercise an insulator function and (just apart from different thicknesses for different conductor cross sections) can be manufactured essentially uniformly, e.g. by pre-molding the plastic. If glass reinforced plastic (GRP) is used as the plastic, the slots can also be made by cutting into the sheets, which can be performed with a uniform slot depth and thus lower production demands, e.g. manually with a single template.

As has already been briefly discussed, the slot widths of at least two receiving slots of a star sheet are preferably different and the compensation sheets preferably have correspondingly adapted different thicknesses to enable winding layers with different conductor cross-sections to be supported.

In an embodiment of the invention, a number of star sheets can be welded at their ends into a star, so that they form holder stars. As an alternative, the star sheets are preferably formed as "star sheet stump", i.e., the star sheets in their installation position do not reach into the central air space of the air-core reactor, in order to save on material and weight.

In any event it is especially useful if, in accordance with further embodiments of the invention, the star sheets have anchorages for spacer strips or tension bandages running between the winding layers, e.g., holes for screwing on or suspending these types of elements.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention will be explained in greater detail below on the basis of an exemplary embodiment presented in the enclosed drawings, in which.

DETAILED DESCRIPTION OF THE EXEMPLARY EMBODIMENTS

Figure 1:
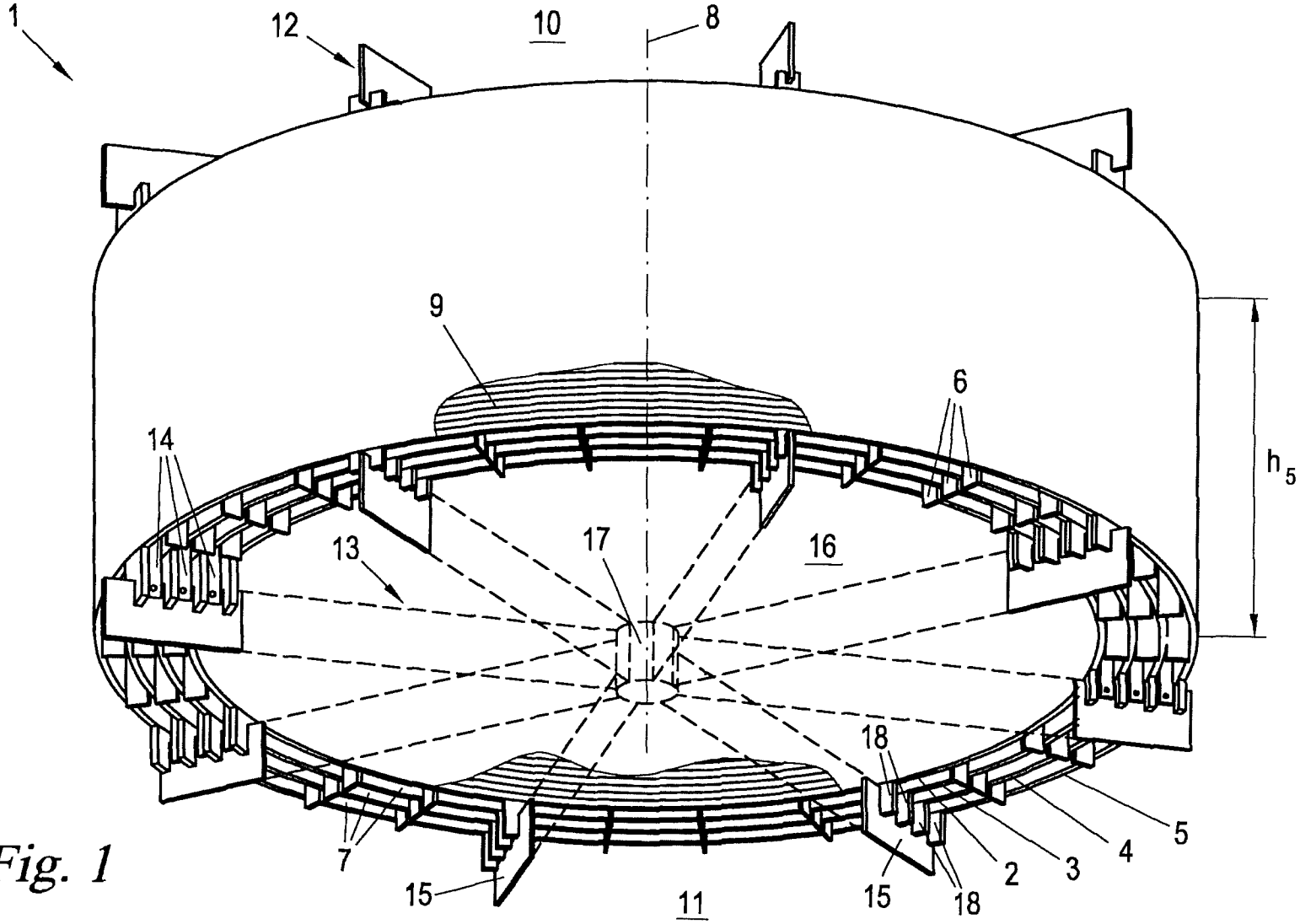
FIG. 1 shows a perspective view of an air-core reactor with two different embodiments (one indicated by dashed lines) of a winding layer pitch compensation in accordance with the invention.

With reference to FIG. 1, an air-core reactor 1, e.g., for high-voltage energy supply networks, has four concentric winding layers 2, 3, 4, 5, which are spaced apart from one another by spacer strips 6 distributed around the circumference to form cooling air gaps 7 between them. In this case, each of the winding layers 2, 3, 4, 5 is formed from a plurality of windings of a conductor 9, such as a wire, wire run or wire cable lying above one another in the axial direction 8 of the air-core reactor 1, and reaches (depending on conductor cross section diameter D and number of windings) an individual winding layer height $h_2$-$h_5$ (only $h_5$ of the outer layer 5 shown).

The winding layers 2, 3, 4, 5 are held together at their upper and lower axial ends 10, 11 by multi-arm holder stars 12, 13, which are tensioned against one another by tensioning bands 14 and/or the spacer strips 6. Here, each holder star 12, 13 is composed from a plurality of radially-disposed star sheets 15, which are shown into forms of embodiment in FIG. 1. In the embodiment of FIG. 1, as shown with dashed extension lines, the star sheets 15 run into the center of the central air space 16 of the air-core reactor 1 and are welded together there at their ends 17, if necessary forming a hub into the holder star 12, 13.

In the version depicted by solid lines in FIG. 1, the star sheets 15 are shortened to "star sheet stumps", which are only disposed in the area below or above the winding layers 2, 3, 4, 5, so that they no longer extend into the central air space 16 of the air-core reactor 1.

As a result of the different installation heights $h_2$-$h_5$ of the different winding layers 2, 3, 4, 5, a winding layer pitch compensation is required between the star sheets 15 and the winding layers 2, 3, 4, 5, more precisely between their first and last windings of the conductor 9, in order to hold each winding layer 2, 3, 4, 5 in a force fit between the respective star sheets 15 lying axially opposite one another. A plurality of individual compensation sheets 18 disposed in each case between a star sheet 15 and a winding layer 2, 3, 4, 5 are used for this, the interaction of which with the star sheets 15 will be explained in greater detail with reference to FIGS. 2, 3, 4.

Figure 2:
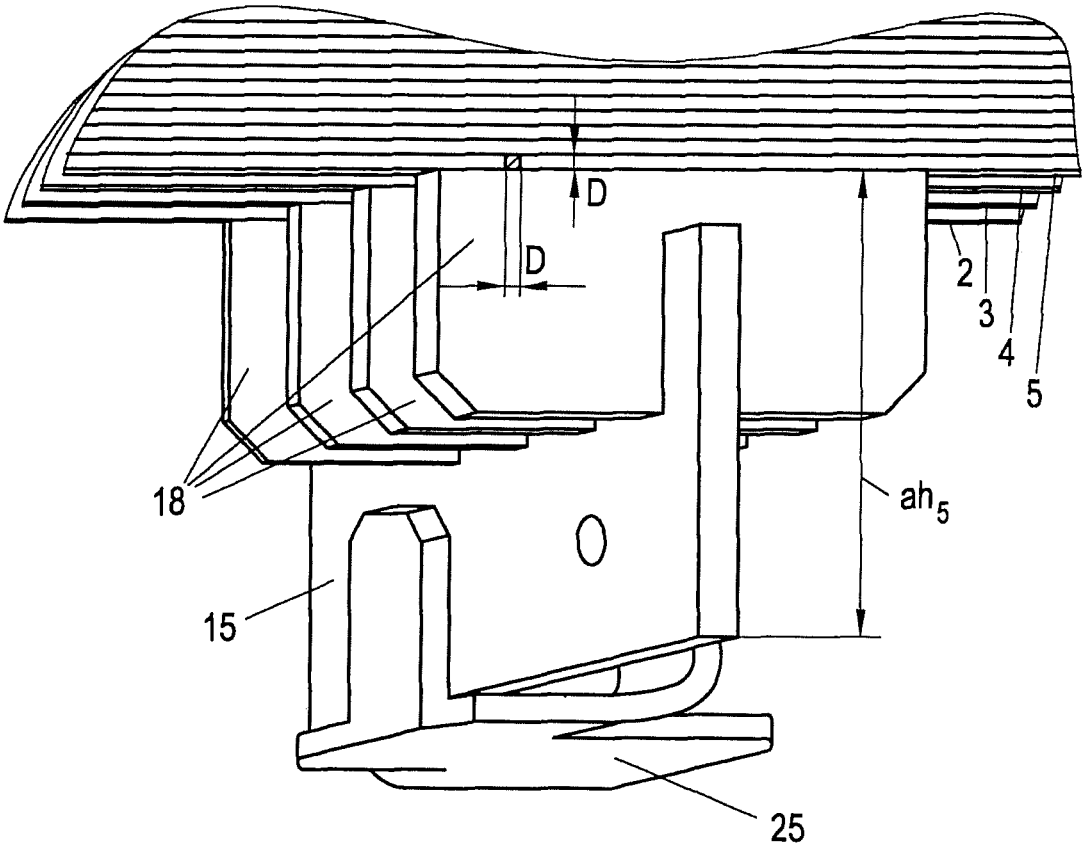
FIG. 2 shows a detailed perspective view of one of the star sheets of the winding layer pitch compensation of FIG. 1 with inserted compensation sheets.
Figure 3:
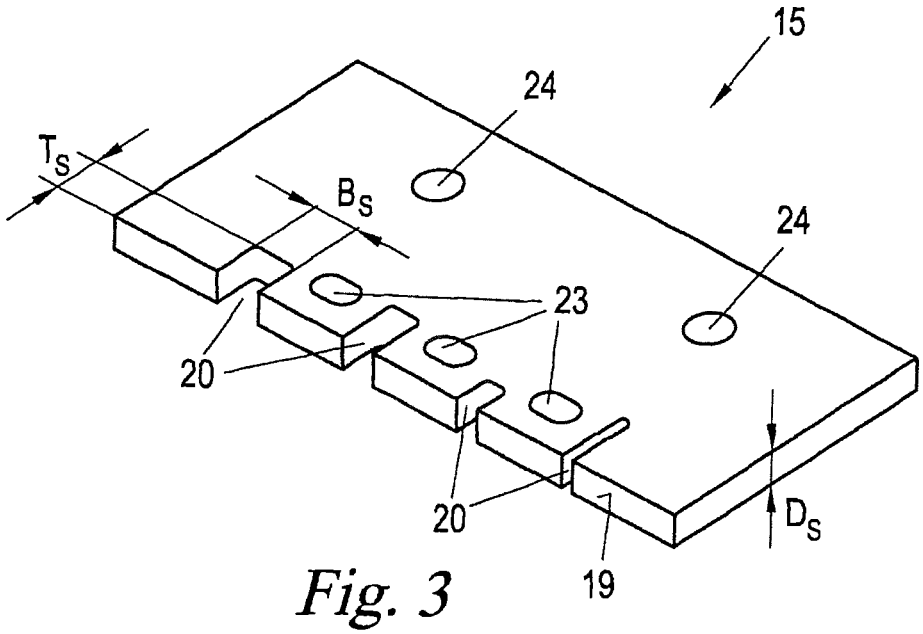
FIGS. 3 and 4 each show a detailed perspective view of a star sheet and a compensation sheet.
Figure 4:
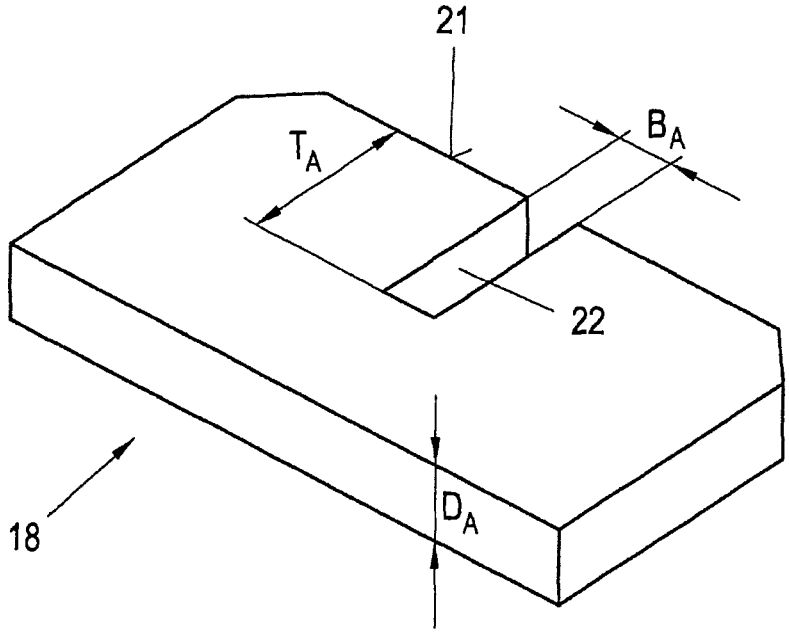

In accordance with FIGS. 2, 3, 4, each star sheet 15 is strip shaped, e.g., in the form of an approximately rectangular small plate, and is provided along a longitudinal edge 19 with a number of receiving slots 20 emanating from the longitudinal edge 19. The number of receiving slots 20 corresponds to the number of winding layers 2, 3, 4, 5 for which the star sheet 15 is intended. For its part, each compensation sheet 18 is strip shaped, e.g., in the form of an approximately rectangular small plate, and is provided with (at least) one insert slot 22 emanating from an edge 21.

A compensation sheet 18 is now able to be inserted into each receiving slot 20 of a star sheet 15 in a form fitting manner such that the star sheet 15 simultaneously engages into the insert slot 22 of the compensation sheet 18 to make a form fit, as shown in FIG. 2. The compensation sheets 18 are thus inserted onto or into the star sheets 15 as a normal or transversely. The slot widths $B_S$ of the receiving slots 20 of the star sheets 15 correspond in each case respectively to the thicknesses $D_A$ of the compensation sheets 18 received therein and, vice versa, in accordance with the slot widths $B_A$ of the slots 22 of the compensation sheets 18, corresponds to the thicknesses $D_S$ of the star sheets 15 inserted into them.

The star sheets 15 preferably have a uniform thickness $D_S$, and correspondingly the slot widths $B_A$ of the insert slots 22 are uniformly the same. The compensation sheets 18, on the other hand, have different thicknesses $D_A$, and these depend on the conductor cross section diameter D of the winding layer 2, 3, 4, 5 to be supported. Accordingly, the slot thicknesses $B_S$ of the receiving slots 20 of the star sheets 15 are also different and are adapted to the thickness $D_A$ of the compensation sheet 18 to be received in each case.

The slot thicknesses $T_A$ of the insert slots 22 of the compensation sheets 18 are preferably (even if not necessarily) uniform. By contrast the slot depths $T_S$ of the different receiving slots 20 of a star sheet 15 are different in each case, i.e., at least two slot depths $T_S$ of two receiving slots 20 are different from one another. This means that the compensation sheets 18 penetrate to different depths into a star sheet 15 and thus create different effective compensation heights $ah_2$, $ah_3$, $ah_4$, $ah_5$ (in FIG. 2 only $ah_5$ is shown for the outermost layer 5) between a star sheet 15 and a winding layer 2, 3, 4, 5. In such cases, star sheets 15 distributed over the circumference of air-core reactor 1 also have increasing or decreasing slot depths $T_S$, in order to receive the rise of the conductor 9 of a winding layer 2, 3, 4, 5 in the course of the first or last winding.

The star sheets 15 are preferably made of metal, especially an aluminum alloy, and the receiving slots 20 therein are preferably made by milling, e.g., CNC milling. The compensation sheets 18 for the purposes of insulation are preferably made of plastic, e.g. glass reinforced plastic (GRP). The insert slots 22 in the compensation sheets 18 can be molded out at the same time during the production of the plastic compensation sheets 18 or can be cut, punched, milled etc. into them subsequently. Here, as a rule, only one uniform slot depth $T_A$ and one uniform slot width $B_A$ are required. As a result, the cutting in of the insert slots 22 can also be performed manually with the aid of a single template.

The star sheets 15 can be equipped with additional anchorages for the spacer strips 6, such as a plurality of holes 23, with which the spacer strips 6 can be screwed on. Further anchorages, such as holes 24, can be provided for additional tension bandages (tension strips) with which the star sheets 15 lying axially opposite one another can be additionally tensioned.

In the production of the air-core reactor 1, the star sheets 15 can be inserted, for example, into holders 25 that can be installed on the turning disk of a winding machine distributed over the circumference and then the compensation sheets 18 (or initially only the radially innermost compensation sheet 18) pushed onto them. After the winding of the first, innermost winding layer 2, a set of spacer strips 6 is distributed over the circumference and screwed to the star sheets 18, then the next compensation sheets 18 (provided this has not yet been done) are placed onto the star sheets 15, then the next winding layer 3 is wound, etc.

It should be understood that in simple forms of embodiments for single-layer reactor cores, the star sheets 15 can each have only one single receiving slot 20, where the receiving slots 20 of different star sheets 15 in a set of star sheets can have different slot depths $T_S$, in order to receive the rise of the conductor 9 over the circumference of the air-core reactor 1.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A winding layer pitch compensation for an air-core reactor, which has at least two radially spaced apart concentric winding layers, comprising:

a plurality of first strip-shaped star sheets, each of said plurality of first strip-shaped star sheets being for a radial arrangement and being respectively arranged below and above the winding layers and being provided along an edge with at least one receiving slot emanating from the edge; and a plurality of second strip-shaped compensation sheets, each of said plurality of second strip-shaped compensation sheets being provided along another edge with at least one insert slot emanating from the other edge, wherein a plurality of respective compensation sheets of the plurality of second strip-shaped compensation sheets is insertable in a form fitting manner into each receiving slot of a respective first strip-shaped star sheet of the plurality of first strip-shaped star sheets which engages in a form fitting manner into a respective insert slot emanating from the other edge of the plurality of second compensation sheets;

wherein slot depths of at least two receiving slots of the plurality of first strip-shaped star sheets are different; and wherein the plurality of first strip-shaped star sheets do not reach into a central air space of the air-core reactor when installed.

2. The winding layer pitch compensation as claimed in claim 1, wherein each of said plurality of first strip-shaped star sheets has at least two receiving slots spaced apart from one another, emanating from the edge, of which the slot depths are different.

3. The winding layer pitch compensation as claimed in claim 1, wherein that the plurality of first strip-shaped star sheets are made of metal and the receiving slots are milled into said plurality of first strip-shaped star sheets.

4. The winding layer pitch compensation as claimed in claim 2, wherein that the plurality of first strip-shaped star sheets are made of metal and the receiving slots are milled into said plurality of first strip-shaped star sheets.

5. The winding layer pitch compensation as claimed in claim 1, wherein the plurality of second strip-shaped compensation sheets along with the respective insert slot are molded or cut from plastic.

6. The winding layer pitch compensation as claimed in claim 1, wherein slot widths of at least two receiving slots of a star sheet of the plurality of first strip-shaped star sheets are different and the second set of strip-shaped compensation sheets have correspondingly adapted different thicknesses.

7. The winding layer pitch compensation as claimed in claim 1, wherein the plurality of the first strip-shaped star sheets are welded at one of their ends to form a star.

8. The winding layer pitch compensation as claimed in claim 1, wherein the plurality of first strip-shaped star sheets have anchorages for spacer strips or tensioning bandages extending between the at least two radially spaced apart concentric winding layers.

* * * * *